US007907857B2

(12) United States Patent
Lee et al.

(10) Patent No.: US 7,907,857 B2
(45) Date of Patent: Mar. 15, 2011

(54) HARD IMAGING METHODS AND HARD IMAGING DEVICES

(75) Inventors: Michael H. Lee, San Jose, CA (US); Quang P. Lam, Hayward, CA (US); Barry J. Oldfield, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 896 days.

(21) Appl. No.: 11/888,215

(22) Filed: Jul. 31, 2007

(65) Prior Publication Data

US 2009/0035003 A1 Feb. 5, 2009

(51) Int. Cl.
*G03G 15/10* (2006.01)

(52) U.S. Cl. ..... 399/57

(58) Field of Classification Search ..... 399/57
See application file for complete search history.

(56) References Cited

U.S. PATENT DOCUMENTS 4,515,463 A * 5/1985 Plumadore ..... 399/142
7,149,459 B2 12/2006 Kamijo et al.
7,151,906 B2 12/2006 Chou et al.
7,233,765 B2 6/2007 Murai et al.

OTHER PUBLICATIONS

"Hard Imaging Methods, Liquid Marking Agent Monitoring Methods, and Hard Imaging Devices"; Eden et al.; Filed Concurently; 24 pp.

* cited by examiner

*Primary Examiner* — David M Gray
*Assistant Examiner* — Erika Villaluna

(57) ABSTRACT

Hard imaging methods and hard imaging devices are described. According to one embodiment, a hard imaging method includes forming a plurality of latent images, using a development assembly, developing the latent images using a liquid marking agent, transporting the liquid marking agent relative to the development assembly during the developing, and performing a bubble reduction operation to reduce a presence of bubbles in the liquid marking agent during the developing and transporting compared with not performing the bubble reduction operation. Additional embodiments are described in the disclosure.

14 Claims, 8 Drawing Sheets

HARD IMAGING METHODS AND HARD IMAGING DEVICES

FIELD OF THE DISCLOSURE

Aspects of the disclosure relate to hard imaging methods and hard imaging devices.

BACKGROUND OF THE DISCLOSURE

Imaging devices capable of printing images upon paper and other media are ubiquitous and used in many applications including monochrome and color applications. For example, laser printers, ink jet printers, and digital printing presses are but a few examples of imaging devices in wide use today for monochrome or color imaging.

Electrophotographic imaging processes utilize a photoconductor which may be electrically charged and then selectively discharged to form latent images. The latent images may be developed and transferred to output media to form hard images upon the media. Electrophotographic imaging processes are implemented in laser printer configurations and digital presses in illustrative examples.

Imaging devices of example embodiments of the present disclosure use a liquid marking agent to develop latent images. At least some embodiments of the disclosure are directed towards apparatus and methods for reducing a presence of bubbles in the liquid marking agent during hard imaging operations. Additional embodiments are described in the following disclosure.

SUMMARY

According to some aspects of the disclosure, hard imaging methods and hard imaging devices are described.

According to one embodiment, a hard imaging method comprises forming a plurality of latent images, using a development assembly, developing the latent images using a liquid marking agent, transporting the liquid marking agent relative to the development assembly during the developing, and performing a bubble reduction operation to reduce a presence of bubbles in the liquid marking agent during the developing and transporting compared with not performing the bubble reduction operation.

According to another embodiment, a hard imaging device comprises a development assembly configured to develop a plurality of latent images using a liquid marking agent, and a marking agent assembly configured to transport the liquid marking agent relative to the development assembly, wherein the marking agent assembly includes a bubble reduction apparatus configured to reduce a presence of bubbles in the liquid marking agent compared with a configuration of the marking agent assembly void of the bubble reduction apparatus.

Other embodiments are described as is apparent from the following discussion.

DESCRIPTION OF THE DRAWINGS

FIG. 7*a* is another illustrative representation of the bubble reduction apparatus of FIG. 7 according to one embodiment.

DETAILED DESCRIPTION

According to some embodiments of the disclosure, hard imaging devices and hard imaging methods utilize a liquid marking agent to develop and form hard images upon media. One form of a liquid marking agent comprises ink particles suspended in a liquid carrier, such as oil. One suitable liquid marking agent is Electroink® available from the Hewlett-Packard Company. During example development operations using a liquid marking agent, the ink particle concentration of the liquid marking agent is increased by several times in a development assembly 18 and applied to a photoconductor to develop latent images formed thereon and at least a substantial portion of the remaining liquid carrier evaporates prior to transfer of the ink particles to media.

As described in further detail below, bubbles may be generated during hard imaging operations and entrained within the liquid marking agent. The presence of bubbles may cause defects in imaging and may cause erroneous results in monitoring of various characteristics of the marking agent, for example, during monitoring of the characteristics to implement calibration operations. Additional details regarding monitoring and calibration are discussed in a co-pending US patent application entitled Hard Imaging Methods, Liquid Marking Agent Monitoring Methods, And Hard Imaging Devices, naming Boaz Eden, William D. Holland, Omer Gila, and Moshe Peles as inventors, assigned to the assignee hereof, filed the same day as the present application, and the teachings of which are incorporated herein by reference. At least some embodiments of the disclosure provide apparatus and methods for reducing the presence of bubbles in the liquid marking agent.

Figure 1:
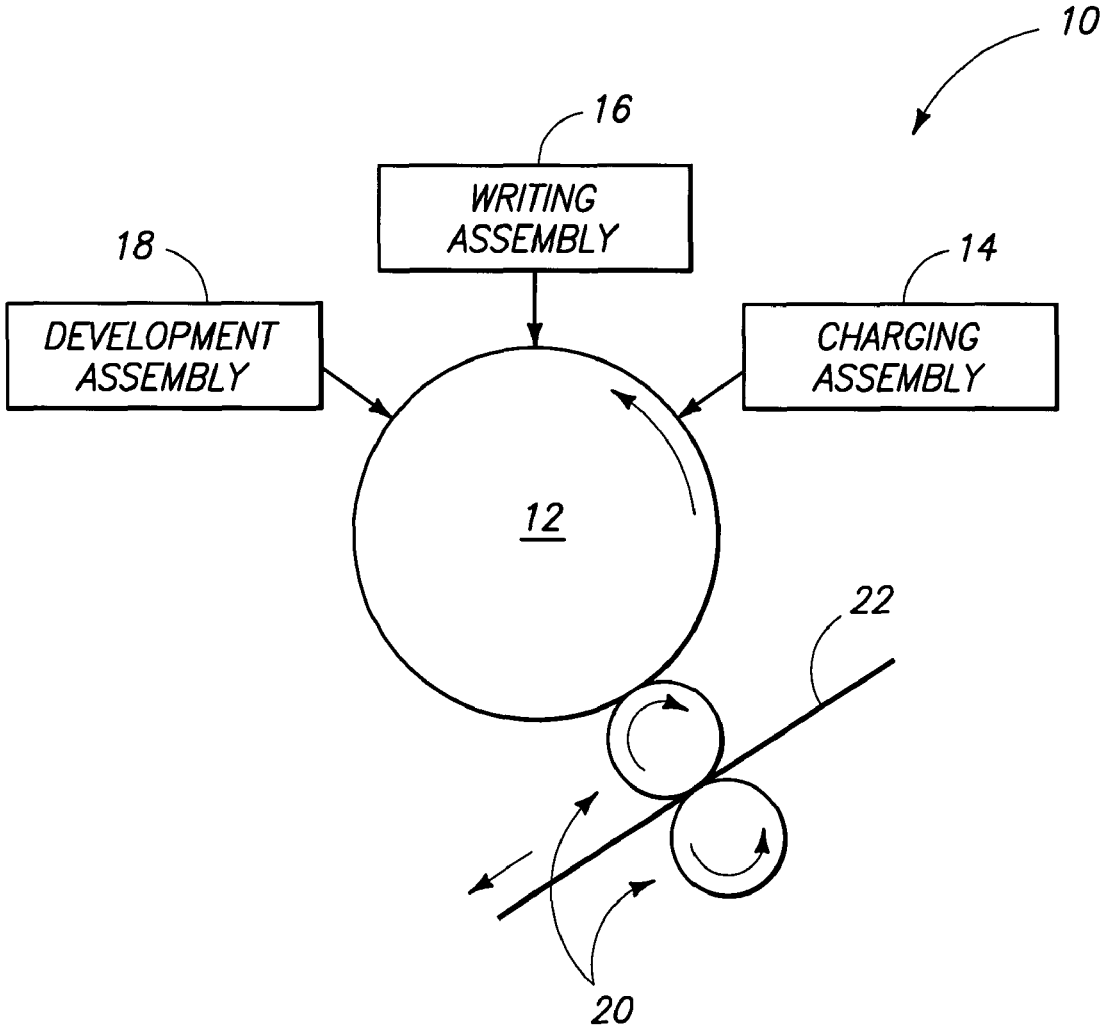
FIG. 1 is an illustrative representation of a hard imaging device according to one embodiment.

Referring to FIG. 1, an example of a hard imagine device 10 is shown according to one illustrative embodiment. The depicted arrangement of the hard imaging device 10 is configured to implement electrophotographic imaging wherein latent images are developed to form developed images which are subsequently transferred to output media. Examples of hard imaging devices 10 include digital presses (e.g., Indigo® presses available from the Hewlett-Packard Company) although other configurations may be used.

The hard imaging device 10 depicted in FIG. 1 includes a photoconductor 12, charging assembly 14, writing assembly 16, development assembly 18, and a transfer assembly 20. Hard imaging device 10 is configured to form hard images upon media 22, such as paper or other suitable imaging substrates. Other hard imaging devices 10 may include more, less or alternative components or other arrangements in other embodiments.

In one operational embodiment, charging assembly 14 is configured to deposit a blanket electrical charge upon substantially an entirety of an outer surface of photoconductor 12. Writing assembly 16 is configured to discharge selected portions of the outer surface of the photoconductor 12 to form latent images. Development assembly 18 is configured to provide a marking agent to the outer surface of photoconductor 12 to develop the latent images formed thereon. In one embodiment, the marking agent is a liquid marking agent. Ink particles of the liquid marking agent may be electrically charged to the same electrical polarity as the blanket charge provided to the outer surface of the photoconductor 12 and attracted to the discharged portions of the outer surface of the photoconductor 12 corresponding to the latent images to develop the latent images. The developed images are transferred by transfer assembly 20 to media 22.

Figure 2:
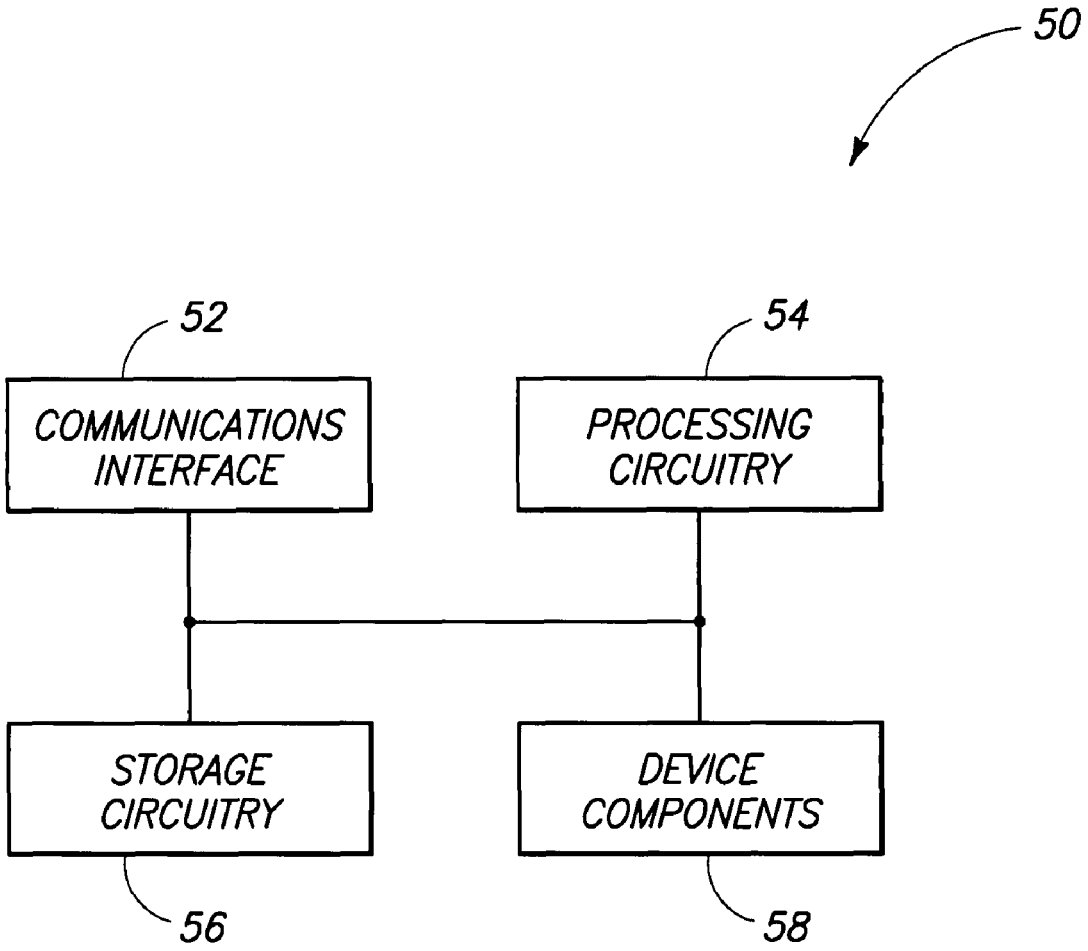
FIG. 2 is a functional block diagram of circuitry of the hard imaging device according to one embodiment.

Referring to FIG. 2, an example of electrical components of hard imaging device 10 is illustrated according to one embodiment. The electrical components include a communications interface 52, processing circuitry 54, storage circuitry 56 and device components 58 in one embodiment of hard imaging device 10. More, less or alternative components are provided in other embodiments of hard imaging device 10.

Communications interface 52 is arranged to implement communications of hard imaging device 10 with respect to external devices (not shown). For example, communications interface 52 may be arranged to communicate information bi-directionally with respect to device 10. Communications interface 12 may be implemented as a network interface card (NIC), serial or parallel connection, USB port, Firewire interface, flash memory interface, floppy disk drive, or any other suitable arrangement for communicating with respect to device 10. In one example, image data of hard images to be formed may be received by communications interface 52.

In one embodiment, processing circuitry 54 is arranged to process data, control data access and storage, issue commands, and control imaging operations of device 10. Processing circuitry 54 may comprise circuitry configured to implement desired programming provided by appropriate media in at least one embodiment. For example, the processing circuitry 54 may be implemented as one or more of a processor and/or other structure configured to execute executable instructions including, for example, software and/or firmware instructions, and/or hardware circuitry. Exemplary embodiments of processing circuitry 54 include hardware logic, PGA, FPGA, ASIC, state machines, and/or other structures alone or in combination with a processor. These examples of processing circuitry 54 are for illustration and other configurations are possible.

Processing circuitry 54 is configured to control imaging operations of device 10, such as the formation and development of latent images upon photoconductor 12. Processing circuitry 54 may also operate as a control system in some embodiments described below to monitor levels of marking agent within development assembly 18 and to control flow of marking agent from development assembly 18 responsive to the monitoring of the level of the marking agent in the development assembly 18. As described below, the monitoring and flow control is implemented in one embodiment to reduce the presence of bubbles in the liquid marking agent.

The storage circuitry 56 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 56 described above and/or communicated via a network or other transmission media and configured to control appropriate processing circuitry. For example, programming may be provided via appropriate media including, for example, embodied within articles of manufacture. In another example, programming may be embodied within a data signal (e.g., modulated carrier wave, data packets, digital representations, etc.) communicated via an appropriate transmission medium, such as a communication network (e.g., the Internet and/or a private network), wired electrical connection, optical connection and/or electromagnetic energy, for example, via a communications interface, or provided using other appropriate communication structure. Exemplary programming including processor-usable code may be communicated as a data signal embodied in a carrier wave in but one example.

Device components 58 include additional electrical components of the hard imaging device 10. For example, device components 58 may include sensors, a pump, motors, a user interface, a level sensor for monitoring a level of marking agent in development assembly 18, variable valves, and other additional electrical components which may be controlled or monitored by processing circuitry 54.

Figure 3:
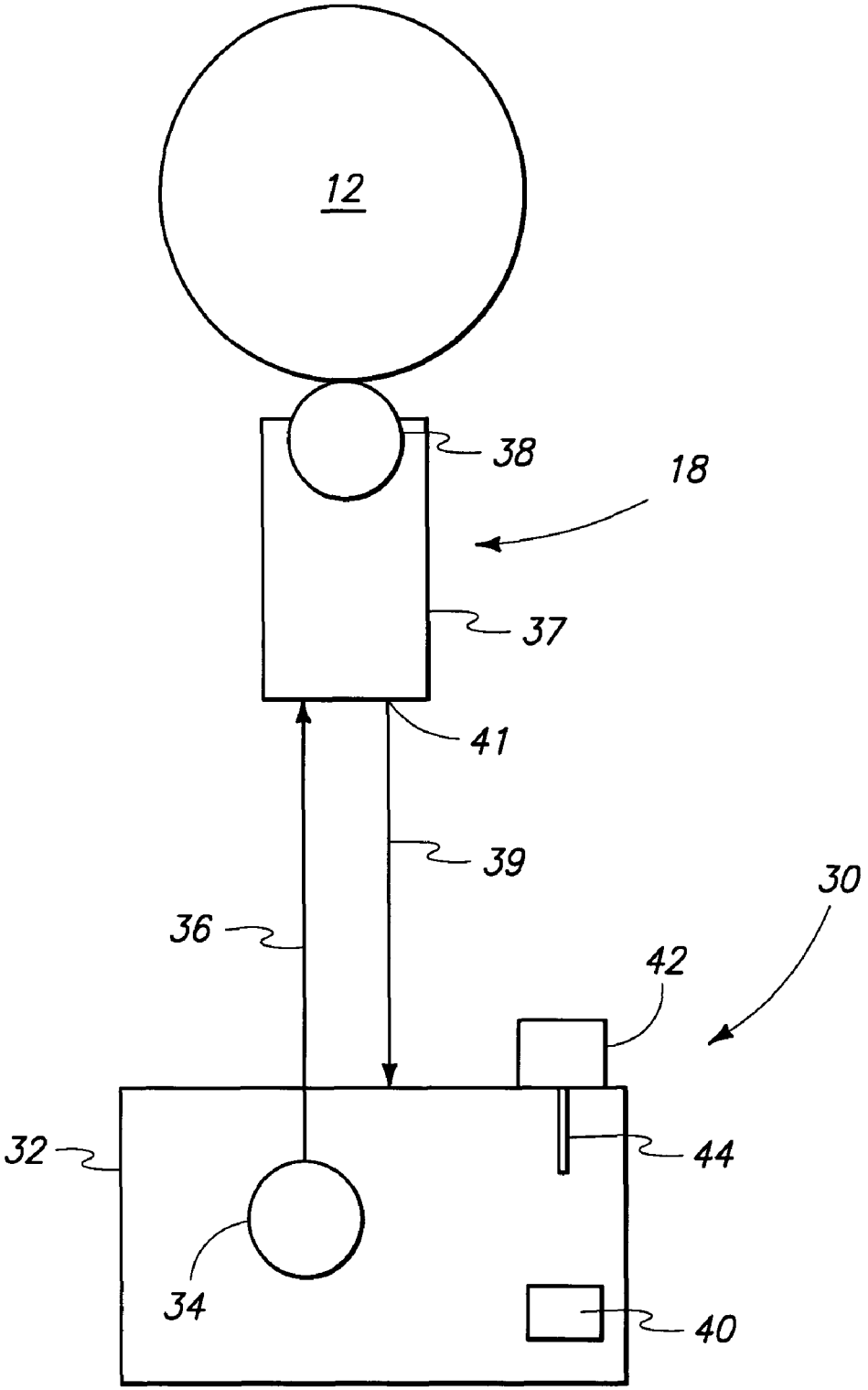
FIG. 3 is an illustrative representation of development operations of the hard imaging device according to one embodiment.

Referring to FIG. 3, additional details of one embodiment of development assembly 18 are shown with respect to one embodiment of a marking agent assembly 30 of hard imaging device 10. A single arrangement of assemblies 18, 30 of FIG. 3 may be used for monochrome hard imaging devices 10. In addition, a plurality of the arrangements of assemblies 18, 30 of FIG. 3 may be used for individual ones of the colors of color hard imaging devices 10.

Marking agent assembly 30 is configured to provide marking agent to development assembly 18 during imaging operations. Marking agent assembly 30 includes a reservoir 32 which contains a supply of the liquid marking agent in the presently described embodiment. A sensor 40 is configured to monitor properties (characteristics) such as density, temperature, and conductivity of the liquid marking agent in reservoir 32. A sensor 42 may be used to calibrate sensor 40. As discussed in the above-mentioned US patent application, it is desired in one embodiment to reduce the presence of bubbles in the liquid marking agent during calibration operations of sensor 40.

A pump 34 is provided to transport the liquid marking agent from reservoir 32 via a supply hose 36 to a chamber 37 of development assembly 18. Development assembly 18 may contain a roller 38 or other appropriate device for providing the liquid marking agent from the chamber 37 to the outer surface of photoconductor 12 to develop latent images. Unused marking agent is returned from chamber 37 to reservoir 32 via a return hose 39 in the depicted embodiment. Supply hose 36 may be referred to as a supply path and return hose 39 may be referred to as a return path in one embodiment. Other configurations of supply and return paths are possible.

As described in the example embodiments of the above-mentioned US patent application, bubbles may be caused by pumping operations of pump 34 during transporting of liquid marking agent from reservoir 32 to development assembly 18 and its return to the reservoir 32. The US patent application mentioned above discloses methods and apparatus for reducing the presence of the bubbles in the liquid marking agent by cycling the pump 34 on and off and altering an operational frequency of the pump 34 during calibration operations. The disclosure of the present application provides additional apparatus and methods for reducing the presence of bubbles in the liquid marking agent during imaging operations of the hard imaging device 10 while hard images are being formed upon media. In one embodiment, at least some of the methods and apparatus of the above-mentioned US patent application and at least some of the methods and apparatus of the present disclosure may be combined and implemented in a single hard imaging device 10. In other embodiments, only one of the methods and apparatus of the above-mentioned US patent application or the methods and apparatus of the present disclosure are implemented in a given hard imaging device 10.

As mentioned previously, liquid marking agent is provided by the supply path from reservoir 32 to development assembly 18 and unused liquid marking agent is returned by the return path to reservoir 32 during imaging operations. The solid ink particles of the liquid marking agent are concentrated by development assembly 18 to develop latent images in one embodiment. For example, the solid ink particles may be electrically charged in one embodiment and attracted to the latent images on the photoconductor 12. Unused and re-diluted ink is returned to reservoir 32 where the solids and other constituents used to develop the images are reintroduced at proper concentrations.

Liquid marking agent transported from development assembly 18 to reservoir 32 may include air in the form of bubbles. As mentioned previously, the presence of bubbles in the liquid marking agent during imaging operations is problematic inasmuch as imaging problems may result when the liquid marking agent is pumped into the development assembly 18. For example, imaging problems which may negatively affect print quality include voids in the concentrated ink layer applied to the photoconductor 12 due to the bubbles and which may result in voids in developed images. Without the presence of bubbles, the concentrated ink layer corresponding to the developed image should be relatively void free.

As mentioned above, movement of the liquid marking agent through the development assembly 18 and its return to reservoir 32 generates bubbles in the liquid marking agent. A major source of bubbles is collision of marking agent which was returned via hose 39 with the marking agent already present in reservoir 32 and by the flow of liquid marking agent around various components (e.g., rollers) inside the development assembly 18. At least some embodiments of the present disclosure are directed towards reducing air entrained by liquid marking agent leaving chamber 37 and entering hose 39 to reduce the presence of bubbles in the liquid marking agent during imaging operations including development of latent images.

In one configuration of hard imaging device 10, development assembly 18 is placed elevationally above reservoir 32 and a siphoning effect resulting from gravity is created during flow of liquid marking agent from chamber 37 to reservoir 32. Observation of liquid marking agent within chamber 37 and hose 39 reveals that air is entrained in the liquid marking agent after flow of the liquid marking agent is established in hose 39 in one embodiment. This described example is related to a siphon effect where falling fluid within the confines of hose 39 is pulled downwardly faster than without the presence of the confinement (i.e., hose 39).

In one embodiment, when liquid marking agent first arrives at development assembly 18, liquid marking agent fills chamber 37 until a steady state ink level is established in development assembly 18. The rising level creates a pressure or "head" which causes a flow rate of marking agent outgoing via hose 39 and a flow rate of marking agent incoming via hose 36 to be the same. If the outgoing rate of liquid marking agent is slower than a rate of incoming marking agent, for example, the level of the marking agent rises in chamber 37 until the increased pressure is sufficient to equalize the rates. However, once siphoning action starts in hose 39 following the introduction of marking agent to hose 39, the outgoing rate increases and the level of marking agent in chamber 37 decreases. Eventually, the level of marking agent present in chamber 37 drops below an outlet opening at an interface 41 of chamber 37 and hose 39 and air is sucked into the liquid marking agent in hose 39 leading to the formation of bubbles.

In example embodiments of the disclosure, apparatus and methods are described to reduce the formation and presence of bubbles in the liquid marking agent being returned to reservoir 32. As described below in some illustrative embodiments, a bubble reduction apparatus is configured to perform bubble reduction operations to reduce the formation and presence of bubbles in the liquid marking agent compared with arrangements wherein the bubble reduction operations are not performed.

In one embodiment, the level of liquid marking agent may be stabilized in chamber 37 if flow rates of liquid marking agent in hose 39 may be adjusted (e.g., restricted). In one configuration, the bubble reduction apparatus is configured to perform a bubble reduction operation comprising selectively restricting flow of the liquid marking agent in the hose 39 to prevent the level of marking agent in the chamber 37 from dropping below interface 41 wherein air is entrained in the liquid marking agent entering hose 39. In one embodiment, the flow of the liquid marking agent in hose 39 is restricted in response to an increase in flow of the liquid marking agent within hose 39. In one embodiment, the size of an aperture of the return path is varied to selectively restrict the flow of the liquid marking agent.

As mentioned above, a siphon action is created during transport of the liquid marking agent in hose 39. The siphon action is created at a moment in time following the initial introduction of liquid marking agent into chamber 37 and hose 39. In one embodiment, methods and apparatus are disclosed for controlling the flow rate of liquid marking agent in hose 39 before and/or after a moment in time when the siphoning action starts.

In one embodiment, the steady state outgoing flow rate of liquid marking agent in hose 39 is roughly three times the flow rate before siphoning action starts. In one embodiment, it is desired to provide additional restriction of flow of the liquid marking agent in hose 39 after the siphon action has started to reduce or minimize suction of air into the liquid marking agent entering hose 39. In some example embodiments, the level of liquid marking agent is stabilized in chamber 37 (e.g., the level is above interface 41 and air suction is avoided) if one or more opening in the return path for transporting liquid marking agent to reservoir 32 is reduced to approximately 30% of the opening(s) size prior to creation of the siphon action. However, in one embodiment, the restricted size of the opening is not implemented prior to the siphon action inasmuch as a level of liquid marking agent in the chamber 37 may rise rapidly and spill out of the development assembly 18. Accordingly, in one embodiment, the bubble reduction apparatus is configured to implement variable opening(s) in the return path for transporting liquid marking agent from chamber 37 to reservoir 32 wherein additional restriction is provided after the siphon action has started compared with restriction prior to starting of the siphon action.

The state of the bubble reduction apparatus before the presence of the siphon action may be referred to as a non-restricted state (i.e., providing substantially no or comparably less flow of the marking agent in hose 39) while the state of the bubble reduction apparatus after the siphon action starts may be referred to as a restricted state (i.e., providing additional restriction to flow of the marking agent compared with the non-restricted state).

Figure 4:
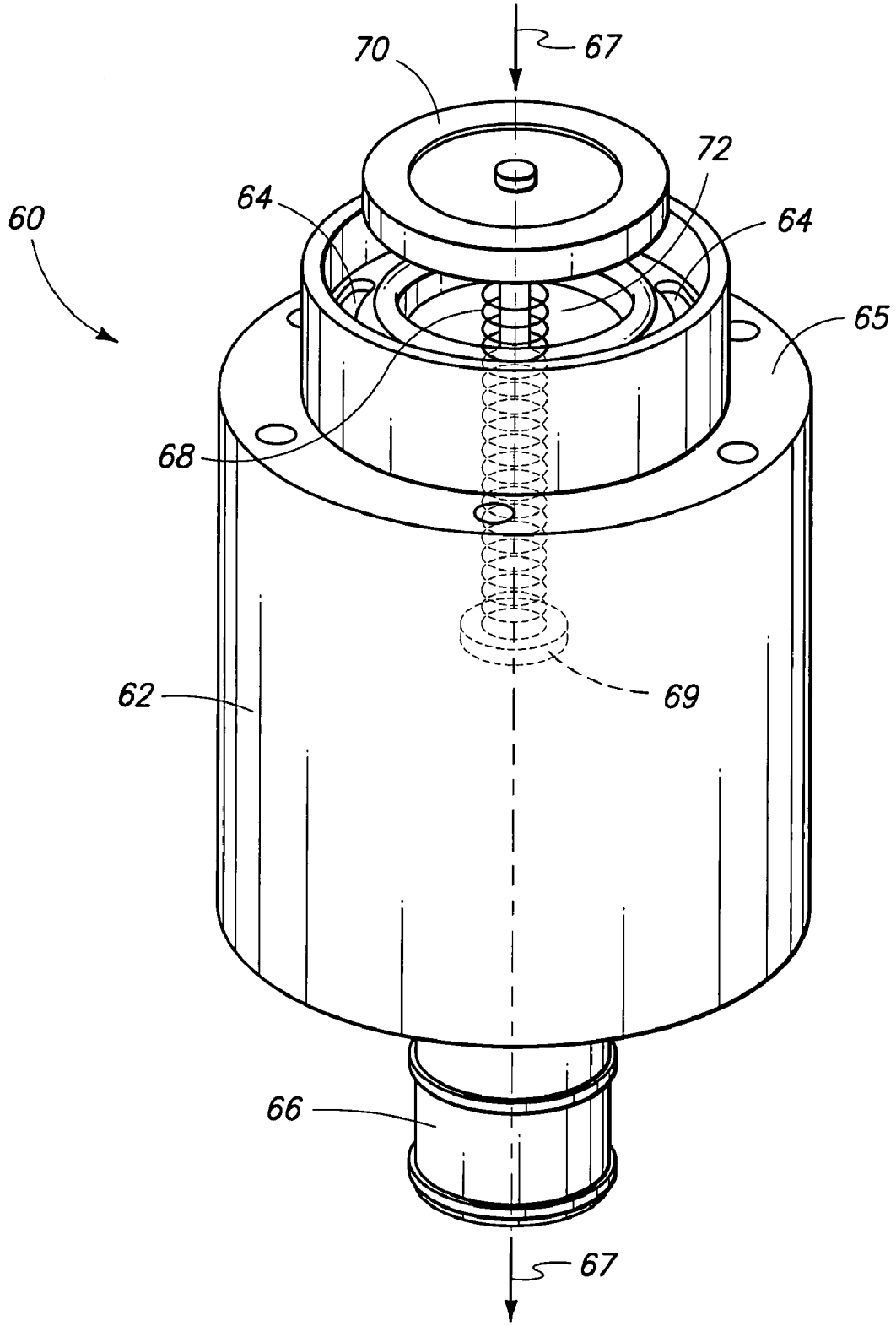
FIG. 4 is an isometric view of a bubble reduction apparatus according to one embodiment.
Figure 5:
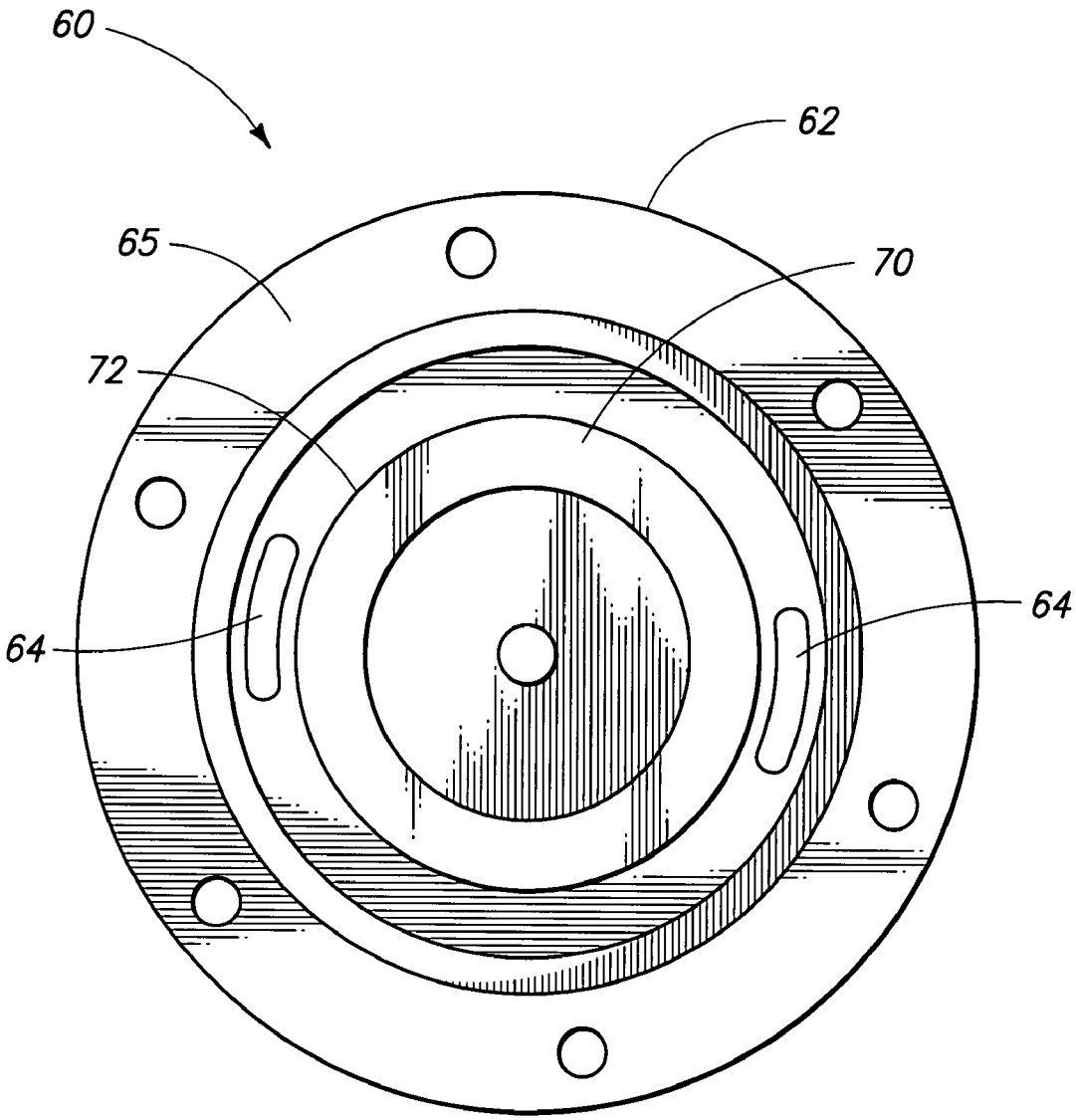
FIG. 5 is a top view of the apparatus of FIG. 4 according to one embodiment.

Referring to FIGS. 4 and 5, a bubble reduction apparatus 60 in the form of a siphon-induced flow restrictor 62 which may be provided in line with return hose 39 is shown. Referring to FIG. 4, apparatus 60 may be positioned at interface 41 (FIG. 3) in one configuration where an end 65 is coupled with chamber 37 and an opposite end 66 is coupled with return hose 39 to provide flow of liquid marking agent in the illustrated direction 67. Apparatus 60 may be positioned at other locations of the return path configured to return unused marking agent from development assembly 18 to reservoir 32 in other embodiments.

Still referring to FIGS. 4 and 5, end 65 includes a plurality of openings 64, 72. One or more openings 64 are located radially outward from opening 72. In the depicted embodiment, two openings 64 are located symmetrically about opening 72. A stopper 70 is provided to at least partially plug opening 72 and to reduce flow of liquid marking agent through apparatus 60 following initiation of the siphon action. In the depicted embodiment, a stop 69 internal to the apparatus 60 is fixed in position relative to a housing of apparatus 60. A spring 68 is connected with the stop 69 and stopper 70. During operation and prior to the creation of the siphon action, spring 68 is configured to urge the stopper 69 upwardly in a non-blocking orientation as shown in FIG. 4 permitting liquid marking agent to freely flow through opening 72. Prior to the occurrence of the siphon action, liquid marking agent may flow in parallel through openings 64, 72.

However, once the siphon action is initiated, the flow of liquid marking agent through apparatus 60 is restricted. In particular, spring 68 is configured such that the increased pressure resulting from an increased rate of flow of the marking agent through hose 39 caused by the siphon action overcomes the force of the spring 68 and causes the stopper 70 to obstruct opening 72 reducing or precluding flow of liquid marking agent through opening 72 while liquid marking agent continues to flow through openings 64 in the described embodiment. In one embodiment, opening 72 has a diameter of approximately ¾" and two openings 64 are provided with individual dimensions of approximately ⅛" by ⅜" for use with an outlet orifice size at end 66 of approximately ⅝" and wherein hose 39 has a length of approximately 1 meter. Openings 64, 72 of different sizes or numbers may be used in other embodiments. As mentioned above, the flow rate of liquid marking agent through apparatus 60 is reduced by approximately 70% following initiation of the siphoning action in one embodiment.

Following the ceasing of delivery of marking agent to chamber 37 by hose 36 and the draining of marking agent within chamber 37 and hose 39 to reservoir 32, the spring 68 is configured to again urge the stopper 70 upwardly to a non-restricting position.

Figure 6:
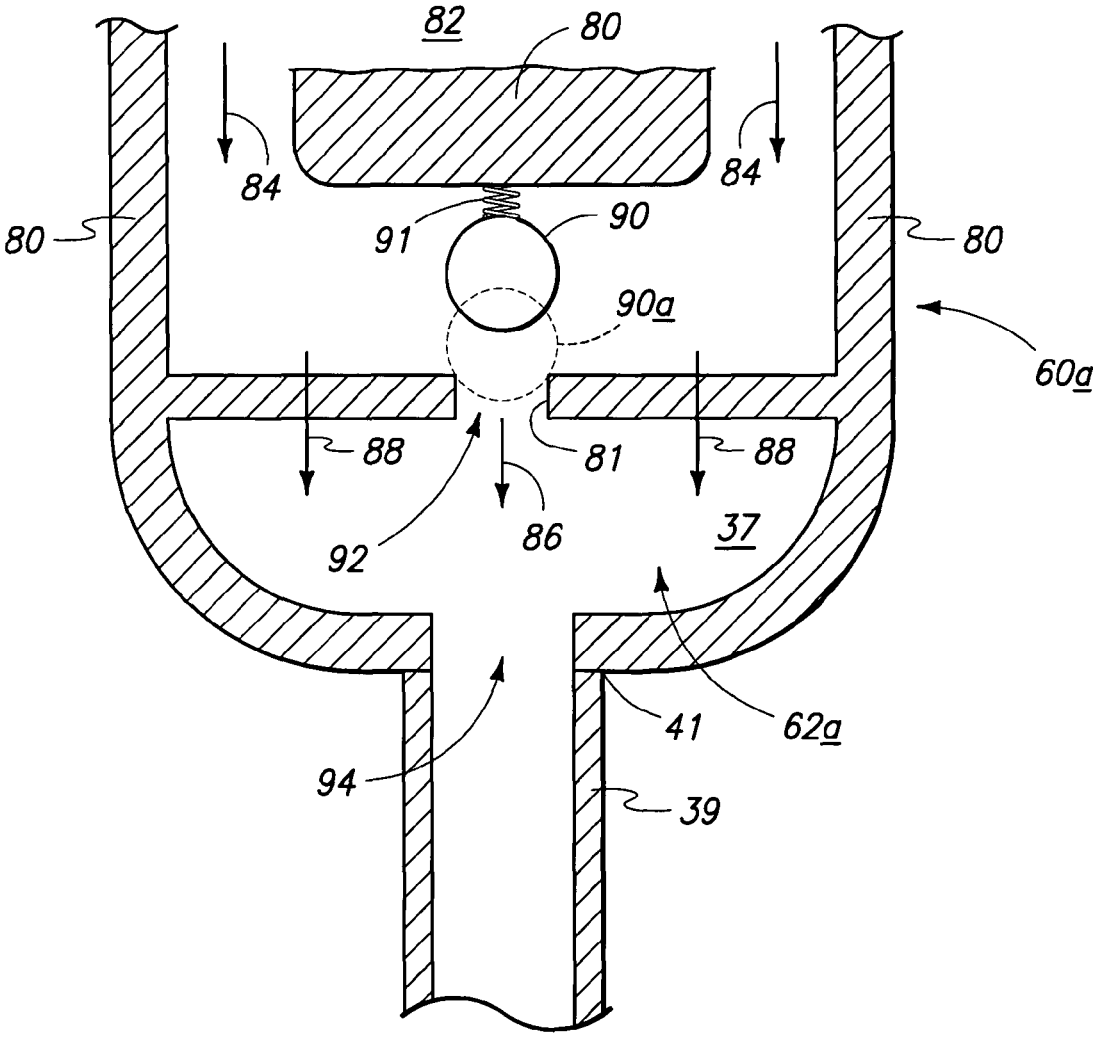
FIG. 6 is an illustrative representation of a development assembly comprising a bubble reduction apparatus according to one embodiment.

Referring to FIG. 6, another embodiment of a bubble reduction apparatus 60*a* is shown in the form of a siphon-induced flow restrictor 62*a* implemented within a housing 80 of development assembly 18 which defines chamber 37. In the depicted embodiment, a lower portion of housing 80 which is configured to receive and collect unused liquid marking agent in chamber 37 is shown. Return hose 39 is coupled with a lower portion of housing 80 at interface 41 in the depicted embodiment. Return hose 39 receives unused marking agent via an exit opening 94 from chamber 37 and transports the unused marking agent to reservoir 32 (not shown in FIG. 6) in one embodiment.

Marking agent is introduced from hose 36 to an upper portion 82 of development assembly 18 during imaging operations to form hard images including development of latent images. Some of the marking agent is applied by roller 38 to a surface of photoconductor 12 (roller 38 and photoconductor 12 are shown in one embodiment in FIG. 3) to develop latent images. Unused marking agent flows downwardly from upper portion 82 as indicated by arrows 84.

In the depicted embodiment, a divider 81 which includes an opening 92 is positioned above exit opening 94. Divider 81 extends laterally between the left and right portions of housing 80 but a gap is provided between divider 81 and either a front or rear wall of the housing (the front or rear wall is not shown in FIG. 6) which permits some marking agent to flow as indicated by arrows 88 around the divider 81 into chamber 37.

In addition, marking agent may also flow through opening 92 into chamber 37 as indicated by arrow 86 prior to creation of a siphon action in return hose 39. For example, in the depicted arrangement, a stopper 90 in the form of a floating ball is positioned above opening 92 and a spring 91 is coupled with an interior wall of housing 80 and is configured to provide stopper 90 in the spaced position relative to opening 92 prior to the creation of the siphon action.

As mentioned above, a siphon action is created in hose 39 during transporting of the marking agent within hose 39 to reservoir 32. A flow rate of the marking agent in hose 39 is increased by the siphon action and which creates a suction force which overcomes the force of spring 91 and pulls stopper 90 into a blocking position 90*a* with respect to opening 92 and which produces increased restriction of flow of marking agent via hose 39 to reservoir 32 compared with flow of the marking agent with stopper 90 spaced from opening 92. Marking agent may continue to flow as indicated by arrows 88 around divider 81 during the presence of the siphon action and while stopper 90 is located at position 90*a*.

Following the ceasing of delivery of marking agent to chamber 37 by hose 36 and the draining of marking agent within chamber 37 and hose 39 to reservoir 32, the spring 91 is configured to again move the stopper 90 upwardly to a non-restricting position.

Figure 7:
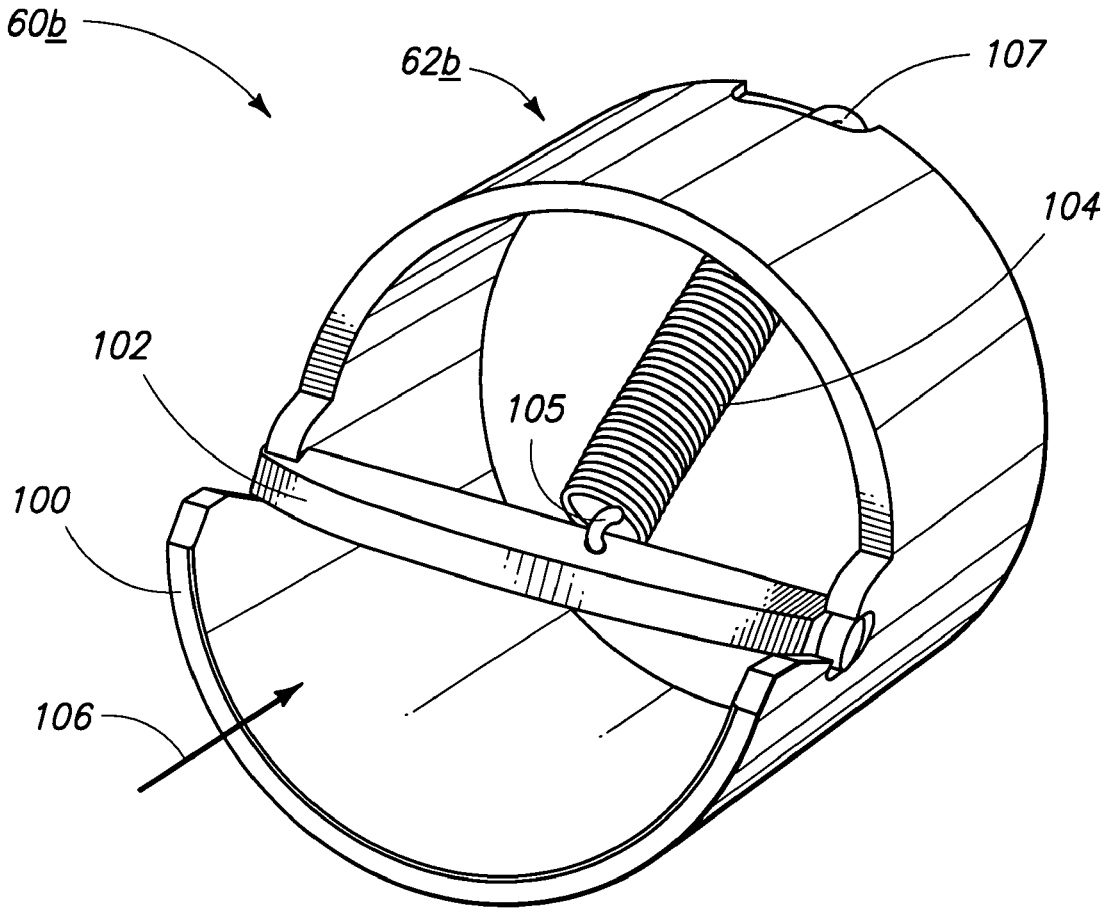
FIG. 7 is an illustrative representation of a bubble reduction apparatus according to one embodiment.
Figure 11A:
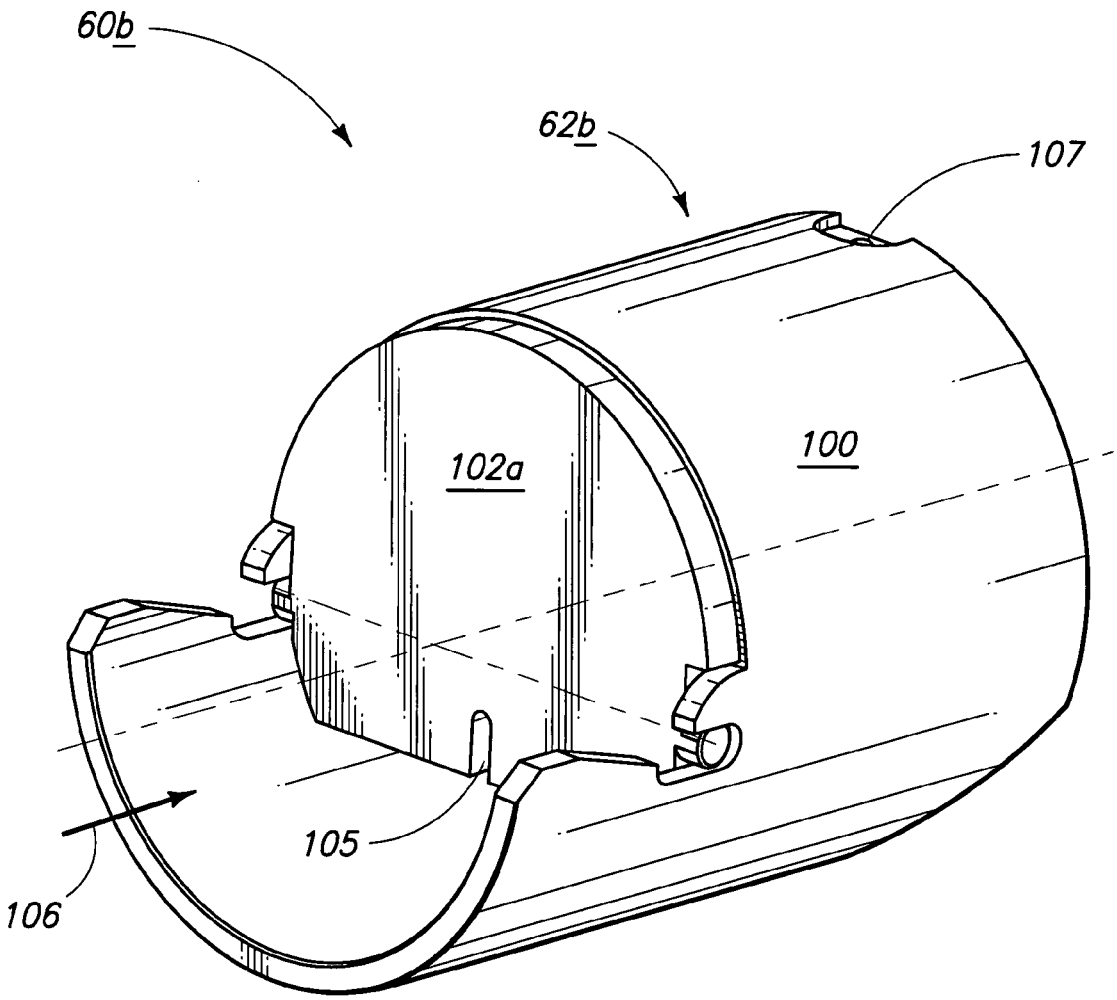

Referring to FIGS. 7 and 7*a*, a bubble reduction apparatus 60*b* in the form of another embodiment of a siphon-induced flow restrictor 62*b* is shown. Restrictor 62*b* is positioned in line with return hose 39 and may be located at interface 41 or at other locations of the return path in illustrative examples. A direction of marking agent flow through apparatus 60*b* is indicated by arrow 106.

Referring to FIG. 7, apparatus 60*b* includes a tubular housing 100 and a flap 102 in the depicted embodiment. Flap 102 is supported by a hinge which permits flap 102 to pivot. A spring 104 is coupled with flap 102 at coupling 105 and housing 100 at coupling 107 and is configured to provide the flap 102 at the "open" position as depicted in FIG. 7 prior to the creation of the siphon action within return hose 39. In the open position, the flap 102 is angled relative to the flow 106 so that a higher flow force is imparted on the upper portion of the flap 102.

Referring to FIG. 7*a*, operation of apparatus 60*b* is described following the creation of the siphon action within return hose 39. In the illustrated embodiment, the suction force overcomes the force of spring 105 and moves flap 102 to the "closed" position 102*a* as depicted. The closed position 102*a* of flap 102 provides a smaller aperture through apparatus 60*b* compared with the open position of flap 102 shown in FIG. 7. Accordingly, flow of marking agent through apparatus 60*b* has additional restriction in the configuration of apparatus 60*b* shown in FIG. 7*a* compared with FIG. 7.

The above-described apparatus 60, 60*a*, 60*b* are illustrative passive embodiments which are configured to provide selective restricted flow of the liquid marking agent in the return path in the presence of the siphon action in the return path without monitoring circuitry or external control circuitry. In other embodiments of the disclosure, active and passive/active hybrid arrangements of bubble reduction apparatus are described. For example, in one passive/active hybrid configuration, the apparatus 60*b* of FIGS. 7 and 7*a* may include a sensor (e.g., one of device components 58 of FIG. 2) and control system (processing circuitry 54 of FIG. 2) configured to sense a level of marking agent within chamber 37. Following the provision of flap 102 at the closed position 102*a* of FIG. 7*a* by a sufficient suction force, the control system may control the position of flap 102 and leakage of marking agent around flap 102 responsive to monitoring of the level of the liquid marking agent in chamber 37 in one embodiment. For example, in one embodiment, apparatus 60*b* may include an electronically controlled lead screw to control the position of flap 102 and to vary a partial opening defined by flap 102 and housing 100 while apparatus 60*b* is in a restricted state of operation. The control may be referred to as fine tune control to provide leakage about flap 102 to account for flow variations of the marking agent within the return hose 39. The control system is configured to maintain a desired amount (e.g., a substantially constant height of marking agent) within chamber 37 which is sufficient to avoid the introduction of air into return hose 39.

In another embodiment, the bubble restriction apparatus may be active wherein the control system monitors a height of the marking agent in chamber 37 before and after the creation of the siphon action and controls a variable valve (e.g., butterfly valve) in the return path to selectively restrict the flow of the marking agent in the return path to provide and maintain a substantially constant level of marking agent within chamber 37 responsive to the monitoring. Active or hybrid arrangements of the bubble restriction apparatus may have some advantages over some passive systems including accounting for flow variations of marking agent within return hose 39. Hybrid systems similar to the apparatus 60*b* of FIGS. 7 and 7*a* have advantages in some arrangements by providing a robust passive arrangement for quickly transitioning from a non-restricted state to a restricted state at the time of creation of the siphon action while also providing monitoring and control for flow variations occurring during the restricted state of operation.

Aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative acts than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. A hard imaging method comprising:

forming a latent image;

using a development assembly, developing the latent image using a liquid marking agent;

transporting the liquid marking agent relative to the development assembly during the developing;

performing a bubble reduction operation to reduce a presence of bubbles in the liquid marking agent during the developing and the transporting compared with not performing the bubble reduction operation, the bubble reduction operation comprising selectively restricting flow of the liquid marking agent being transported from the development assembly; and monitoring a level of the liquid marking agent in the development assembly, the restricting being responsive to the monitoring.

2. The method of claim 1 wherein the transporting comprises transporting the liquid marking agent from the development assembly within a return path, the flow of the liquid marking agent in the return path increases during the transporting, and the restricting is responsive to the increase of flow of the liquid marking agent in the return path.

3. The method of claim 1 wherein a siphon action is created at a moment in time during the transporting of the liquid marking agent from the development assembly, and wherein the performing comprises restricting flow of the liquid marking agent being transported from the development assembly after the moment in time compared with flow of the liquid marking agent being transported from the development assembly before the moment in time.

4. The method of claim 1 wherein the performing comprises maintaining a desired amount of the liquid marking agent within the development assembly during the developing and the transporting.

5. The method of claim 4 wherein the transporting comprises transporting the liquid marking agent from the development assembly using a return path, and the maintaining comprises maintaining to avoid introduction of air into the return path.

6. A hard imaging method comprising:

forming a latent image;

using a development assembly, developing the latent image using a liquid marking agent;

transporting the liquid marking agent relative to the development assembly during the developing; and performing a bubble reduction operation to reduce a presence of bubbles in the liquid marking agent during the developing and the transporting compared with not performing the bubble reduction operation, wherein the transporting comprises transporting the liquid marking agent from the development assembly using a return path, and wherein the performing comprises varying a size of an aperture in the return path.

7. A hard imaging device comprising:

a development assembly to develop a latent image using a liquid marking agent; and a marking agent assembly to transport the liquid marking agent from the development assembly, the marking agent assembly including a bubble reduction apparatus to reduce a presence of bubbles in the liquid marking agent compared with a configuration of the marking agent assembly void of the bubble reduction apparatus, the bubble reduction apparatus to operate in a non-restricting state at one moment in time and to operate in a restricting state at another moment in time, the flow of the liquid marking agent from the development assembly during the operation of the bubble reduction apparatus in the restricting state being restricted compared with the operation of the bubble reduction apparatus in the non-restricting state.

8. The device of claim 7 wherein the bubble reduction apparatus is to selectively restrict flow of the liquid marking agent from the development assembly to reduce the presence of the bubbles.

9. The device of claim 7 wherein the bubble reduction apparatus is to restrict flow of the liquid marking agent from the development assembly responsive to an increase in the flow of the liquid marking agent from the development assembly.

10. The device of claim 7 wherein the bubble reduction apparatus is to initially operate in the non-restricting state and to change to the restricting state responsive to increased flow of the liquid marking agent from the development assembly.

11. The device of claim 7 wherein a siphon action is created within a return path of the marking agent assembly during transport of the liquid marking agent from the development assembly, and the bubble reduction apparatus is to provide increased restriction of flow of the liquid marking agent within the return path after the creation of the siphon action as compared with the flow of the liquid marking agent in the return path prior to the creation of the siphon action.

12. The device of claim 7 wherein the bubble reduction apparatus is to provide a sufficient level of liquid marking agent in the development assembly to reduce introduction of air into a return path of the marking agent assembly, the marking agent assembly to transport the liquid marking agent from the development assembly.

13. A hard imaging device comprising:

a development assembly to develop a latent image using a liquid marking agent;

a marking agent assembly to transport the liquid marking agent relative to the development assembly, the marking agent assembly including a bubble reduction apparatus to reduce a presence of bubbles in the liquid marking agent compared with a configuration of the marking agent assembly void of the bubble reduction apparatus, the bubble reduction apparatus to selectively restrict flow of the liquid marking agent from the development assembly to reduce the presence of the bubbles; and a control system to monitor a level of the liquid marking agent in the development assembly and to control the restriction of the flow responsive to the monitoring.

14. A hard imaging device comprising:

a development assembly to develop a latent image using a liquid marking agent; and a marking agent assembly to transport the liquid marking agent from the development assembly, the marking agent assembly including a bubble reduction apparatus to reduce a presence of bubbles in the liquid marking agent compared with a configuration of the marking agent assembly void of the bubble reduction apparatus, the marking agent assembly comprising a return path to transport the liquid marking agent from the development assembly, the bubble reduction apparatus to vary a size of an aperture in the return path to reduce the presence of the bubbles in the liquid marking agent.

* * * * *